US006991041B2

(12) United States Patent
Laskaris et al.

(10) Patent No.: US 6,991,041 B2
(45) Date of Patent: Jan. 31, 2006

(54) COMPRESSED AIR FOAM PUMPING SYSTEM

(75) Inventors: Michael A. Laskaris, Collegeville, PA (US); Allen Craig, Dunnellon, FL (US)

(73) Assignee: Hale Products, Inc., Conshohocken, PA (US)

( * ) Notice: Subject to any disclaimer, the term of this patent is extended or adjusted under 35 U.S.C. 154(b) by 137 days.

(21) Appl. No.: 10/377,319

(22) Filed: Feb. 28, 2003

(65) Prior Publication Data

US 2004/0177975 A1 Sep. 16, 2004

(51) Int. Cl.
*A62C 35/00* (2006.01)

(52) U.S. Cl. ..... 169/14; 169/5; 169/13; 169/15; 169/71; 239/67; 239/68; 239/318; 239/422; 239/428; 239/433

(58) Field of Classification Search ..... 169/5, 169/13, 14, 15, 24, 30, 71, 85, 91; 239/67, 239/68, 310, 318, 422, 428, 433
See application file for complete search history.

(56) References Cited

U.S. PATENT DOCUMENTS

| | | | | |
|---|---|---|---|---|
| 4,448,256 A | | 5/1984 | Eberhardt et al. | |
| 5,145,014 A | | 9/1992 | Eberhardt | |
| 5,255,747 A | | 10/1993 | Teske et al. | |
| 5,291,951 A | * | 3/1994 | Morand | 169/14 |
| 5,411,100 A | | 5/1995 | Laskaris et al. | |
| 5,427,181 A | | 6/1995 | Laskaris et al. | |
| 5,727,933 A | | 3/1998 | Laskaris et al. | |
| 5,803,596 A | * | 9/1998 | Stephens | 169/15 |
| RE36,196 E | | 4/1999 | Eberhardt | |
| 5,996,700 A | | 12/1999 | Sulmone | |
| 6,009,953 A | | 1/2000 | Laskaris et al. | |
| 6,109,359 A | * | 8/2000 | Ballard | 169/14 |
| 6,276,459 B1 | * | 8/2001 | Herrick et al. | 169/14 |
| 6,357,532 B1 | | 3/2002 | Laskaris et al. | |
| 6,733,004 B2 | * | 5/2004 | Crawley | 169/14 |

* cited by examiner

*Primary Examiner*—Steven J. Ganey
(74) *Attorney, Agent, or Firm*—Akin Gump Strauss Hauer & Feld, L.L.P.

(57) ABSTRACT

A compressed air foam system for use in extinguishing fire includes a conduit, a water flow sensor, a foam proportioning apparatus, an air conduit, an air flow sensor, an air flow control valve and a system controller. The water flow sensor is configured to sense a water flow rate through the conduit. The air flow sensor is configured to sense an air flow rate through the air conduit. The system controller has a user adjustable ratio input. The system controller is configured to receive the sensed water flow rate, to receive the sensed air flow rate, to output a first control signal to the air flow control valve and to output a second control signal to the foam proportioning apparatus. The system controller automatically adjusts the first and second control signals to maintain a ratio of air flow to foam flow based upon the user adjustable ratio input.

17 Claims, 4 Drawing Sheets

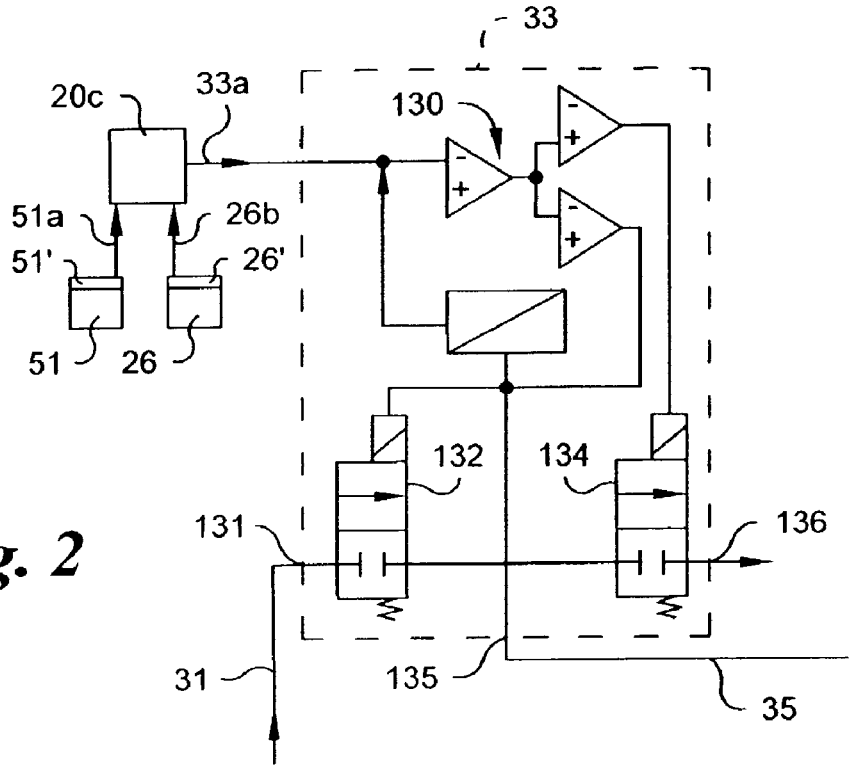
Fig. 2
Fig. 4
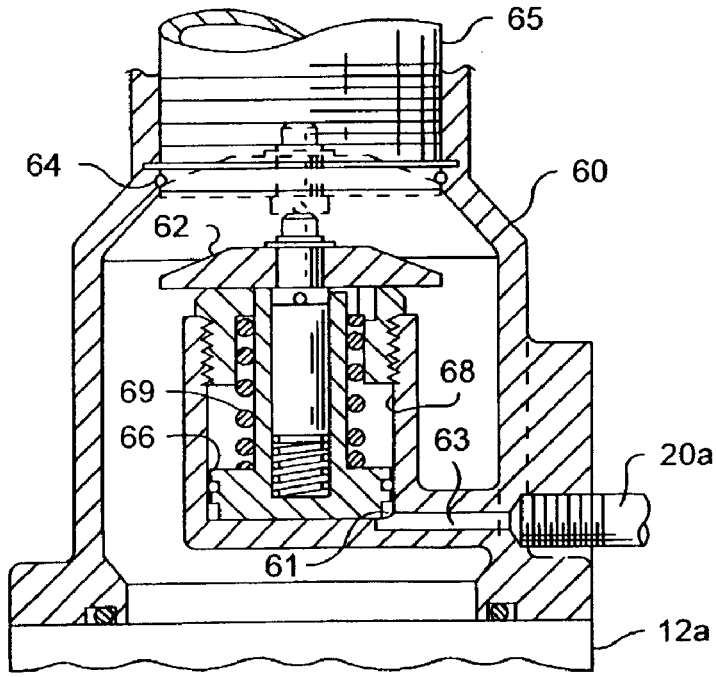

COMPRESSED AIR FOAM PUMPING SYSTEM

BACKGROUND OF THE INVENTION

The present invention generally relates to firefighting equipment, and more specifically, to compressed air foam systems used to mix a stream of water with foam chemical and compressed air to produce a water/foam/air mixture for firefighting purposes. Even more specifically, the present invention relates to systems for controlling the introduction of air into the water and foam chemical mixture ratiometrically.

The addition of foaming agents to firefighting water streams is known and can be particularly useful for fighting fires, for example, fires in industrial factories, chemical plants, petrochemical plants and petroleum refineries. The use of compressed air firefighting foam requires that air and a foam concentrate be mixed and added at constant proportions to the water stream. When the foam extinguisher solution is delivered, the foam effectively extinguishes the flames of chemical and petroleum fires as well as Class A materials which would otherwise not be effectively extinguished by the application of water alone.

Foam supply systems are known in the art by the term CAFS (Compressed Air Foam System) and WEPS (Water Expansion Pumping System). A typical system includes a foam injector system, a water pumping system, and an air system including an air compressor for supplying air under pressure. For example, when employing mixture ratios of 1 CFM of air to 1 GPM of water, these systems can produce very desirable results in fire fighting by the use of "Class A" or "Class B" foams to help achieve fire suppression and to deal with increased fire loads and related hazards.

Control of the foam concentrate addition to the water stream in the appropriate proportion is significant. If an excessive amount of foam concentrate is added, a lower fire-extinguishing quality can result due to an increased foam viscosity which limits the flowability of the foam and the ability of the foam to be spread on the fire. Further, the addition of excessive amounts of foam concentrate to the water stream increases the cost of the use of the foam and the frequency at which the foam concentrate supply must be replenished at the scene. With Class A foam, surface tension reduction is optimum at a specific injection ratio; too much or too little foam chemical will lead to increased surface tension which limits water absorption into Class A or woody, cellulose type fuels. Thus, it is important to fire fighting efficiencies to maintain proper control of the foam injection rate.

The amount of air added to the water and foam chemical mixture must also be properly regulated and controlled in the appropriate proportion. Controlling the amount of air introduced into the water and foam chemical mixture is necessary to achieve the desired consistency of foam. Firefighting foam that is either too watery due to insufficient air or too dry due to excessive air is less effective at fighting fires. Dry foam made by adding extra air to the foam solution has value in exposure protection and sealing the vapors on liquid spills; however, it is not effective for direct fire attack because there is not enough water content in the foam to cool the fuels.

As the nozzle operated by the firefighter at the end of the hose line is closed, extra air or water will tend to flow into the hose line depending on which one has a higher pressure. This may contribute to an unbalanced foam mixture. Existing firefighting foam systems have had difficulties in maintaining the pressures of the water and air equal to each other. The condition in which an excessive amount of air is introduced with the nozzle closed to create the foam is commonly referred to as air packing or just packing of the hose. Some firefighting foam systems recognized this and proportion the air introduced into the water using a venturi device. However, existing air proportioned systems generally increase the size, weight and cost of the firefighting foam system. Other firefighting foam systems use an operator to control the introduction of air by constantly making manual adjustments to maintain a desired foam mixture. Changes in hose elevation, length, nozzle opening and nozzle type can require the operator to compensate with manual adjustments.

In addition to controlling the introduction of air into the water and foam chemical stream to achieve a desired foam consistency, it is also desirable to reduce the air flow or completely shut off the air flow under certain conditions. For example, if foam chemical is not being added to the water then air should stop being introduced into the water stream. Air and water do not mix under pressure. If air is added to the water without the foam chemical the unmixed air and water will cause violent surging of the firefighting hoses, commonly called slug flow. The violent surging action can be sufficiently forceful to knockdown or injure the firefighter who is operating the fire hose.

When using the prior art systems without automatic controls, it is difficult under fire fighting conditions to maintain the water pressure and the air pressure at desired levels. At a fire fighting scene, unless an operator is present at all times to observe the flow conditions and is skilled at operating the equipment to make the necessary adjustments thereof, it is possible for the system to run out of water, to run out of foam, to lose prime in the water pump, to mix air with water by itself without the foam concentrate, to put air into the system by itself, and to even overpressurize the air. The occurrence of any of the above events, in addition to the occurrence of other possible problems, can be hazardous to the firefighter.

Some CAFS that adequately control the air/foam and water/foam ratios are disclosed in U.S. Pat. Nos. 5,255,747 of Teske et al. and 5,411,100 of Laskaris et al., which are incorporated by reference herein. The system of U.S. Pat. No. 5,411,100, in particular, discloses an automatically controlled CAFS which automatically controls compressed air flow.

However, what is needed but not provided by the prior art is an improved compressed air foam system which automatically controls the air flow into the mixture. Further, what is needed but not provided by the prior art is an improved compressed air foam system which automatically controls the ratio of air to foam into the mixture to optimize the resultant mixed output. Even further, what is needed but not provided by the prior art is a compressed air foam system which automatically controls the water flow to achieve higher air concentrations than otherwise possible.

BRIEF SUMMARY OF THE INVENTION

The present invention comprises a compressed air foam system for use in extinguishing fire. The compressed air foam system includes a mixer, a solution discharge device, a fire pump, a conduit, a water flow sensor, a foam proportioning apparatus, an air conduit, an air flow sensor, an air flow control valve and a system controller. The mixer has an inlet and an outlet. The solution discharge device is configured to receive mixed aerated foam solution from the outlet of the mixer and to output the mixed aerated foam solution from the system. The fire pump has a suction port and a discharge port. The fire pump is configured to pump water under pressure from the discharge port. The suction port is in fluid communication with a water source. The conduit provides a fluid path between the discharge port of the fire pump and the inlet of the mixer. The water flow sensor is configured to sense a water flow rate of the water flowing through the conduit. The foam proportioning apparatus is configured to inject foam chemical into the water flowing through the system. The air conduit is configured to inject compressed air at an air injection point into the water flowing through one of the conduit and the mixer. The air conduit is in fluid communication with a source of compressed air. The air flow sensor is configured to sense an air flow rate of the air flowing through the air conduit. The air flow control valve is configured to control the flow of the compressed air through the air conduit. The system controller has a user adjustable ratio input. The system controller is configured to receive the sensed water flow rate from the water flow sensor, to receive the sensed air flow rate from the air flow sensor, to output a first control signal to the air flow control valve for regulating the flow of compressed air and to output a second control signal to the foam proportioning apparatus for regulating the flow of foam relative to the sensed water flow rate. The system controller automatically adjusts the first and second control signals to maintain a ratio of air flow to foam flow based upon the user adjustable ratio input.

The present invention also comprises a control system for a compressed air foam system. The compressed air foam system has at least a pumped water line, a compressed air line coupled to an air source and to the water line, and a foam concentrate line coupled to a foam source and to the water line. The control system includes a water flow sensor, a water pressure sensor, an air flow sensor, an air flow control valve, a foam proportioning apparatus, and a system controller. The water flow sensor is configured to sense a flow rate of the water flowing through the water line. The water pressure sensor is configured to sense a water pressure of the water flowing through the water line. The air flow sensor is configured to sense a flow rate of the air flowing through the air line. The air flow control valve is configured to variably throttle the air flowing through the air line and into the water flowing through the system. The foam proportioning apparatus is configured to meter the foam chemical flowing through the foam concentrate line and into the water flowing through the system. The system controller has a user adjustable ratio input. The system controller is configured to receive the sensed water flow rate from the water flow sensor, to receive the sensed air flow rate from the air flow sensor, to output a first control signal to the air flow control valve for regulating the flow of air and to output a second control signal to the foam proportioning apparatus for regulating the flow of foam relative to the water flow rate. The system controller automatically adjusts the first and second control signals to maintain a user adjustable ratio of air flow to foam flow.

The present invention also comprises a compressed air foam system for use in extinguishing fire including a mixer, a solution discharge device, a fire pump, a conduit, a foam proportioning apparatus, an air conduit and a variable water restriction device. The mixer has an inlet and an outlet. The solution discharge device is configured to receive mixed aerated foam solution from the outlet of the mixer and output the mixed aerated foam solution from the system. The fire pump has a suction port and a discharge port. The fire pump is configured to pump water under pressure from the discharge port. The suction port is in fluid communication with a water source. The conduit provides a fluid path between the discharge port of the fire pump and the inlet of the mixer. The foam proportioning apparatus is configured to inject foam chemical into the water flowing through the conduit. The air conduit is configured to inject air into the water flowing through one of the conduit and the mixer. The air conduit is in fluid communication with a source of compressed air. The variable water restriction device is disposed in the conduit. The variable water restriction device is configured to selectively reduce water flow and pressure when a user desires to create an aerated mixed foam solution having higher air concentrations once the flow rate of the air being injected has reached a maximum attainable value.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings:

FIG. 2 is a schematic view of an air pressure regulator and electric control valve used in the system shown in FIG. 1;

FIG. 4 is a sectional view of an inlet throttling valve for an air compressor for use with the system of FIG. 1.

DETAILED DESCRIPTION OF THE INVENTION

Figure 1:
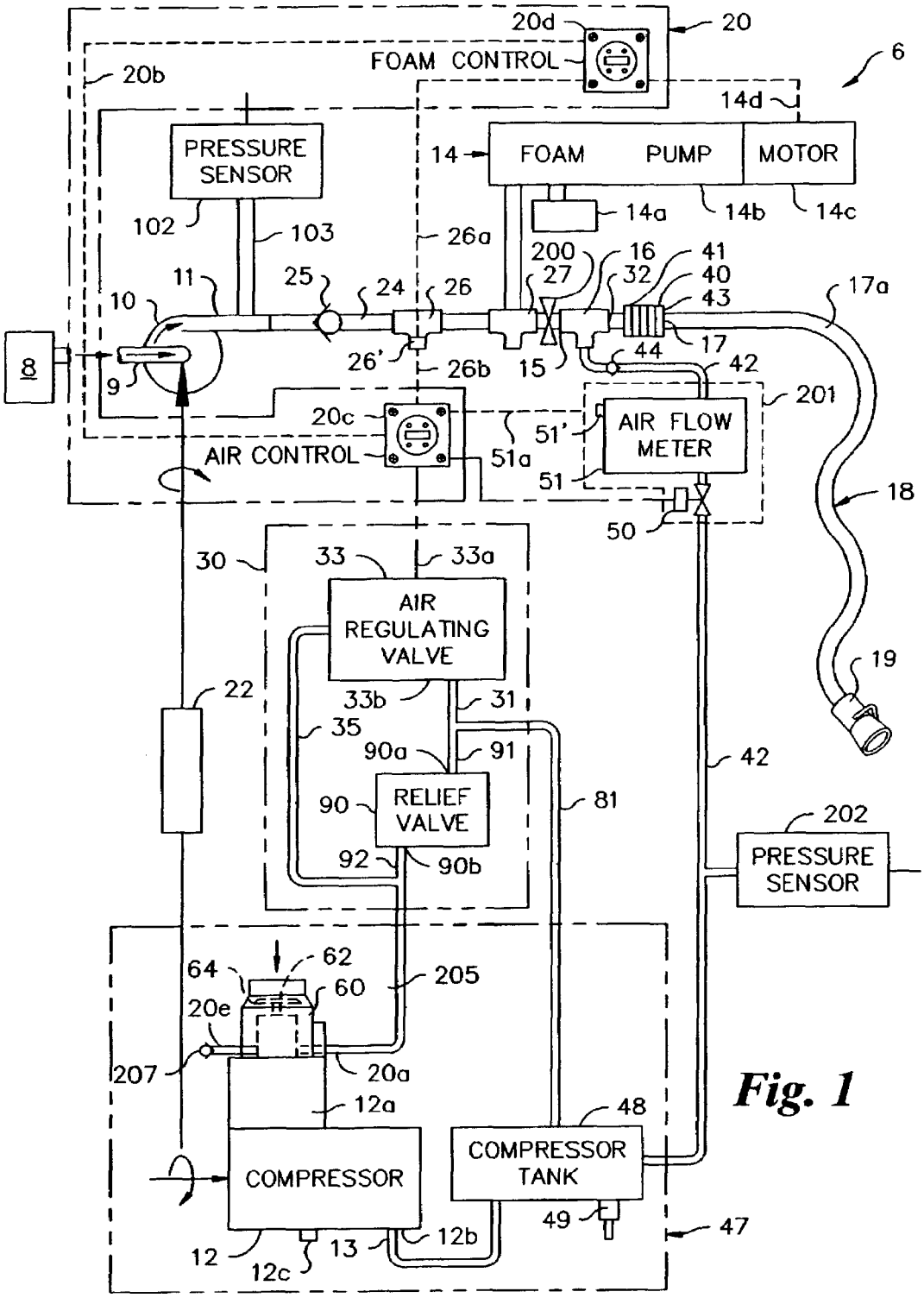
FIG. 1 is a schematic view of a compressed air foam system in accordance with a first preferred embodiment of the invention.

Certain terminology is used in the following description for convenience only and is not limiting. The words "right", "left", "lower", and "upper" designate directions in the drawings to which reference is made. The words "inwardly" and "outwardly" refer direction toward and away from, respectively, the geometric center of the compressed air foam system and designated parts thereof. The terminology includes the words above specifically mentioned, derivatives thereof and words of similar import. Additionally, the word "a", as used in the claims and in the corresponding portions of the specification, means "at least one."

Referring to the drawings in detail, wherein like reference numerals indicate like elements throughout, there is shown in FIGS. 1–4 a compressed air foam system 6 in accordance with a first preferred embodiment of the present invention including a mixer 40, a solution discharge device 18, a fire pump 10, a conduit 24, a water flow sensor or water flowmeter 26, a foam proportioning apparatus 14, an air conduit 42, an air flow sensor or air flowmeter 51, an air flow control valve 60, an air injector 16 and a system controller 20. The mixer 40 has an inlet 41 and an outlet 43. The solution discharge device 18 is configured to receive mixed aerated foam solution from the outlet 43 of the mixer 40 and to output the mixed aerated foam solution from the system 6. The fire pump has a suction port 9 and a discharge port 11. The fire pump 10 is configured to pump water under pressure from the discharge port 11. The suction port 9 is in fluid communication with a water source 8. The conduit 24 provides a fluid path between the discharge port 11 of the fire pump 10 and the inlet 41 of the mixer 40. The water flow sensor 26 is configured to sense a water flow rate of the water flowing through the conduit 24. The foam proportioning apparatus 14 is configured to inject foam chemical into the water flowing through the system 6. The air conduit 42 is configured to inject compressed air at an air injection point, in this case at the air injector 16, into the water flowing through one of the conduit 24 and the mixer 40. The air conduit 42 is in fluid communication with a source of compressed air as will be described in greater detail below. The air flow sensor 51 is configured to sense an air flow rate of the air flowing through the air conduit 42. The air flow control valve 60 is configured to control the flow of the compressed air through the air conduit 42. The system controller 20 has a user adjustable ratio input which is entered via a keypad 132 (FIG. 3B). The system controller 20 is configured to receive the sensed water flow rate from the water flow sensor 26, to receive the sensed air flow rate from the air flow sensor 51, to output a first control signal to the air flow control valve 60 for regulating the flow of compressed air and to output a second control signal to the foam proportioning apparatus 14 for regulating the flow of foam relative to the sensed water flow rate. The system controller 20 automatically adjusts the first and second control signals to maintain a ratio of air flow to foam flow based upon the user adjustable ratio input.

The fire pump 10 is a suitable water pump which delivers water under pressure from the discharge 11. The fire pump 10 is preferably a single-stage centrifugal pump which has impellers mounted on a rotating drive shaft and may be, for example, a QMAX 150 midship pump manufactured by Hale Fire Pump Company.

The mixer 40 is an improved type of motionless mixer which is described in U.S. Pat. No. 5,427,181 of Laskaris et al., which is incorporated by reference herein. Briefly, the mixer 40 comprises a plurality of flanges which are provided with fingers to create turbulence without losing much pressure as the mixture of foam solution and air flows from the air injector 16 to the upstream end 17 of the solution discharge device 18. Mixers of this type are known in the art as motionless or static mixers and function to enhance mixing by adding turbulence to the flow while keeping the pressure loss to a minimum. Of course other types of mixers 40, such as pumps, strainers, propellers and the like may be utilized without departing from the present invention. Additionally, if the system 6 has a significant length of discharge hose 17*a* (on the order of 150 feet of 1½ inch hose), the discharge hose 17*a* can function as the mixer 40. Essentially what is needed for the mixer 40 is enough turbulence and frictional "scrubbing" to make a sufficient foam and water mix. But, the mixer 40 is not critical to the present invention, and therefore, shall not be described in greater detail herein.

The solution discharge device 18 can take various forms, such as a deck gun or one or more fire hoses with nozzles at the end thereof. In FIG. 1, the solution discharge device 18 is shown as a single fire hose 17*a* having a nozzle 19 as is commonly known in the art. Of course the particular discharge device 18 is not critical to the present invention and may be any type of discharge device.

Preferably, the source of compressed air 47 includes an air tank 48 and an air compressor 12 having an intake 12*a* and a discharge 12*b*. The air compressor 12 draws in air from the intake 12*a* and discharges compressed air out of the compressor discharge 12*b* to the air conduit 42. Preferably, the air flow control valve 60 is coupled to the intake 12*a* of the air compressor 12. The air compressor 12 is preferably a rotary type of compressor of a conventional construction and comprises a rotating drive shaft (not shown). By way of example, the compressor 12 is constructed to operate at up to 400 cubic feet per minute (CFM). The design of the compressor 12 must allow for throttling the inlet air flow as a way to control the air discharge flow and pressure.

A transmission or power take-off 22 of the type disclosed in U.S. Pat. No. 5,145,014 of Eberhardt, the contents of which is incorporated by reference herein, is provided to cause rotation of the drive shafts of both the fire pump 10 and compressor 12 from the transmission on the fire truck. The power take-off 22 includes a split shaft gearbox (not shown) arranged to cause rotation of the drive shafts of the fire pump 10 and compressor 12 whereby said shafts are caused to rotate at a set proportional speed. Of course any power take-off device may be utilized without departing from the present invention including a dedicated electrical or internal combustion engine and the like.

The conduit 24 extends between the discharge 11 of the fire pump 10 and the inlet 15 of air injector 16 and includes therebetween, in the direction of flow, a check valve 25 and a foam injector 27. The check valve 25 is constructed and arranged to permit flow in the direction from discharge 11 to the inlet 15 of the air injector 16 and block reverse flow (i.e., flow in the opposite direction). The foam injector 27 is connected as part of the flow proportioning apparatus 14 as will be described hereafter. The water flowmeter 26 is also disposed along this portion of the conduit 24. By way of example, the flowmeter 26 may be a Hale FoamMaster Paddlewheel flowmeter as manufactured by Class 1, Ocala, Fla. The water flowmeter 26 includes a transmitter 26' which transmits an electrical signal corresponding to the rate of water flow therethrough. Of course other types of flowmeters may be utilized such as venturi tubes, orifice plates, vortex meters, propeller meters and the like without departing from the spirit of the present invention.

The foam proportioning apparatus 14 may be of any suitable type well known in the art, such as that used in the FoamMaster series electronic injection automatic foam proportioning system manufactured by Hale Products Inc. In this type or system, the proportioning apparatus 14 includes a foam concentrate pump 14*b* and an electric variable speed motor 14*c* for driving the pump, as is shown in FIG. 1. The proportioning apparatus 14 is controlled based on the water flow through the water flowmeter 26 as will be described in greater detail hereinafter.

As best shown in FIG. 1, the air injector 16 comprises a tee connection having an inlet 15, which is connected to the downstream end of the conduit 24 as shown in FIG. 1, and an outlet 32 which is connected to direct the flow from the air injector 16 into a mixer 40. The mixer 40 is connected at its downstream end to the upstream end 17 of the fire hose 17*a* of the solution discharge device 18 as is shown in FIG. 1. The air injector 16 also comprises an inlet portion providing an air inlet for receiving air flow delivered from air compressor 12 as will be described hereafter. The air injector tee or simply the injector 16, may be constructed of any commercially available fittings as the control unit 20 compensates for pressure drop and flow characteristics in the range of operation.

The air conduit 42 for delivering air to the air inlet portion of air injector 16 includes a check valve 44 connected therein and configured to permit flow into the air injector 16 and to prevent flow in the opposite direction. The preferred method of construction for the check valve 44 is two independent check valves arranged at least several pipe diameters apart to prevent water back flow into the sensor. This is commonly known in the industry as a double detector check valve arrangement. The air conduit 42 also has a shut-off valve 50 connected therein for controlling flow therethrough, and an air flowmeter 51 connected therein for measuring flow therethrough. The shut-off valve 50 is actuable between open and closed positions. Optionally, the shut-off valve 50 is an integral part of the air flowmeter 51 and is just a solenoid configured to keep an inner piston of the air flowmeter 51 in a closed position, and the shut-off valve 50 and air flowmeter 51 are indicated as a combined device 201 on FIG. 1. The air flowmeter 51 may be of any suitable type such as the Hale SCFM Air Flowmeter manufactured by Hale Fire Pump Company. The air flowmeter 51 has a air flowmeter transmitter 51' which transmits an electric signal corresponding to the rate of air flow therethrough, the signal being sent to system controller 20 via electrical line 51*a*.

The air compressor 12 is arranged to deliver air at a delivery pressure to the upstream end of air conduit 42. To this end, the discharge 13 of compressor 12 is connected to the compressor tank 48 which provides a capacity or buffer of compressed air at the compressor discharge pressure. The upstream end of the air conduit 42 is connected to the compressor tank 48 to receive a supply of air at the compressor discharge pressure whereby the conduit 42 delivers air to the air to air injector 16 through the shut-off valve 50, the air flowmeter 51 and the check valve 44.

Air is supplied to compressor 12 through an inlet 12*a*. The air flow control valve 60 is configured to vary the flow of air to the inlet 12*a* of compressor 12 to thereby control the compressor discharge pressure. Compressor tank 48 is provided with a conventional pressure relief valve 49 which prevents the system from being subjected to a high pressure which could cause damage to the components thereof. By way of example, the relief valve 49 is set to open the compressor tank 48 to the atmosphere.

In order to control the compressor discharge pressure, air flow control valve 60 is provided with a control valve member 62 which cooperates with a valve seat 64 to vary the amount of the air flow to the compressor inlet 12*a* in response to a pilot or control air pressure from the air regulating valve 33. The control valve member 62 is constructed and arranged to be positioned relative to the valve seat 64 to control the amount of air entering the air compressor 12 through inlet 12*a* until the compressor discharge pressure provides an air flow through line 42. The inlet throttling valve 60 is of a type well known in the art such as those manufactured by Aircon Inc., Erie, Pa., which is shown in detail in FIG. 4.

As shown in cross-section in FIG. 4, the air flow control valve 60 includes the control valve member 62 which is mounted for movement with a control piston 66 guided for movement in a cylinder 68 which defines a control chamber 61 at the one (lower) side of the control piston 66. The pilot or control pressure is delivered to the control chamber 61 by way of a passage 63 formed in the body of valve 60, the upstream end of the passage 63 being in flow communication with a flow line 20*a* communicating therewith and mounted in the side of the body of the valve 60. The flow line 20*a* delivers the pilot or control air pressure to valve 60 so that it, in effect, controls or modulates the compressor discharge pressure by controlling the inlet air volume. The control valve member 62 cooperates with the valve seat 64 and moves between the solid line (or fully opened) position shown in FIG. 4 and a closed position as shown in dotted lines in FIG. 4. The upstream side of the valve seat 64 is connected to atmosphere by an inlet tube 65 as is conventional in the art. A spring 69 biases the valve member 62 toward the full open position against the control air pressure. Accordingly, the air flow control valve 60 is a fail open type valve.

Figure 3B:
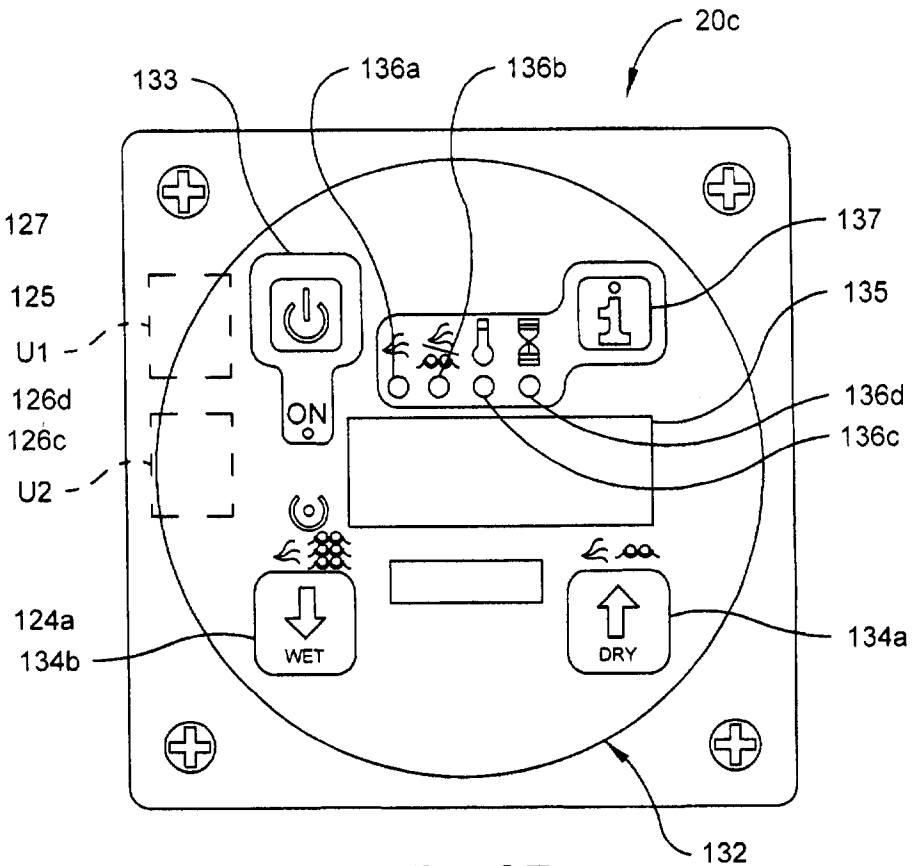
FIG. 3B is a front elevational view of an air flow controller for use with the system of FIG. 1.
Figure 3A:
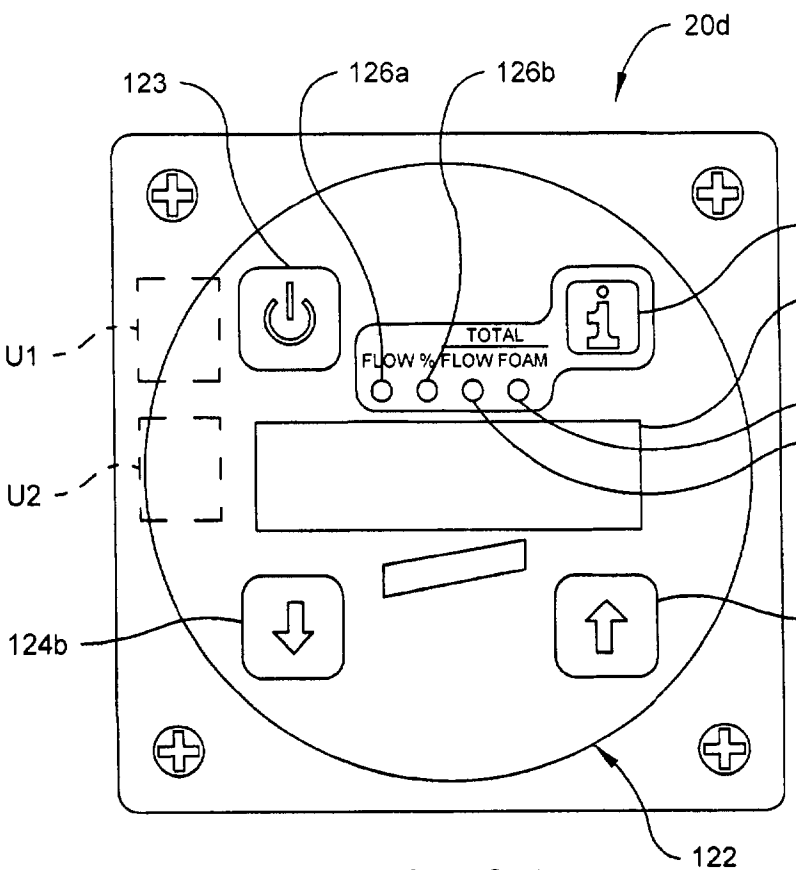
FIG. 3A is a front elevational view of a foam flow controller for use with the system of FIG. 1.

Referring now to FIGS. 1 and 3A–3B, preferably, the system controller 20 includes an air flow controller 20*c* and a foam flow controller 20*d*. The air flow controller 20*c* is configured to receive the sensed air flow rate from the air flow sensor 51 and to output the first control signal to the air flow control valve 60 for regulating the flow of air. The foam flow controller 20*d* is configured to receive the sensed water flow rate from the water flow sensor 26 and to output the second control signal to the foam proportioning apparatus 14 for regulating the flow of foam. Preferably, the foam flow controller 20*d* communicates to the air flow controller 20*c* in order to automatically adjust the first and second control signals and in order to maintain the user adjustable ratio of air flow to foam flow as a function of the sensed water flow rate. In one configuration, the foam flow controller 20*d* communicates to the air flow controller 20*c* by a hardwired network cable 20*b*, such as an RS485-type cable, using a standard communication protocol. Of course other communications methods can be utilized without departing from the present invention including radio frequency (RF), infrared (IR), fiber optic, Ethernet and the like.

Preferably, the foam flow controller 20*d* and the air flow controller 20*c* each include a memory U2 and a processor U1. The processor U1 is preferably a programmable microprocessor manufactured by Intel, but the processor U1 may be another device such as a microcontroller, an application specific integrated circuit (ASIC), a programmable logic array (PAL) and the like, without departing from the invention.

FIG. 3B shows that the air flow controller 20*d* has a keypad 132 including an on/off pushbutton 133, up and down arrow keys 134*a*, 134*b*, a digital readout or display 135 and mode indicator lights 136*a*–136*d*. The mode indicator lights 136*a*–136*d* are for indicating which variable is being displayed on the digital display 135 and which mode the air flow controller 20*d* is set to operate. The mode indicator lights 136*a*–136*d* include water flow pacing 136*a*, adjustable percent ratio of air to foam flow and water flow 136*b*, the air temperature 136*c* and the time 136*d*. By pressing a mode or information button 137, a user can scroll or scan through the four different display modes indicated by mode indicator lights 136*a*–136*d*. When the percent of air flow to water flow is selected, the user can use the up and down arrow keys 134*a*, 134*b* to increase or decrease the desired setpoint for pacing the air to water between 0.0% and 100%. Likewise, when the adjustable percent ratio of air to foam flow and water flow is selected, the user can also use the up and down arrow keys 134*a*, 134*b* to increase or decrease the desired setpoint for pacing the adjustable percent ratio of air to foam flow and water flow between 0.0% and 100%.

The air flow controller 20*c* has two sensor inputs which receives input control signals through the electrical lines 51*a* and 26*b* which transmit electrical signals from air flowmeter transmitter 51' and the water flowmeter transmitter 26' of the air and water flowmeters 51 and 26, respectively. It is contemplated that the water flow is provided from the foam flow controller 20*d* by way of the network connection 20*b* in lieu of providing an additional water flow sensor input in the air flow controller 20*c*. The microprocessor U1 of the air flow controller 20*c* has a user adjustable setpoint for air/water ratio, and an output, electrically connected to the air regulating valve 33 by way of the electrical line 33*a*.

Flow line 20*a*, which delivers the pilot or control air pressure to valve 60 in order to control or modulate the compressor discharge pressure, is part of an air regulating system 30 which is configured to regulate the air pressure in the flow line 20*a*. The air regulating system 30 includes an air regulating valve 33 and a relief valve 90 both having their respective inlet connections 90*a* and 33*b* in fluid communication with the compressor tank 48 outlet via conduits 31 and 91 that combine into a tee fitting communicating to conduit 81. The air regulating system 30 also includes a line 31 connected between flow line 81 and the inlet or supply port of the air regulating valve 33, and a line 35 connected between the outlet port of the air regulating valve 33 and conduit 205 to communicate to the control chamber 61 of the inlet throttling valve 60 via flow line 20*a*. The control chamber 61 is vented thru connection 20*e* and relief valve 207 to the atmosphere.

The air regulating system 30 is a flow-through system and inherently functions with a throttling action as air flows through the air regulating valve 33 communicating to connection 20*a* of the air flow control valve 60 through conduit 35 and 205 act to change the net air pressure delivered to air flow control valve 60. The air regulating valve 33 may be a proportional flow control valve as used in the industry or preferably is an on/off solenoid-type valve controlled by pulse width modulation (PWM) or other suitable signal as required to change the net air pressure delivered to the air flow control valve 60. One such valve is made by Parker Hannifin Corporation as is known in industry. Thus, the air controller 20*c* has control over the air flow control valve 60 and can modulate the discharge flow and air pressure from air compressor 12 by modulating the intake air flow through the air flow control valve 60.

Referring to FIG. 2, the air regulating valve 33 is an electrically controlled valve of a well known type constructed to receive an electric control signal from the system controller 20 to vary the air pressure delivered to the pilot line 20*a*. While various types of electrically controlled air control valves may be used as the air regulating valve 33, one suitable valve is the Model SPC1R of Buzmatics Corporation of Indianapolis, Ind. This valve, which is shown schematically in FIG. 2, comprises solid state electronics, indicated generally at 130, an intake valve 132, an exhaust valve 134, a relieving pressure exhaust port 136, an air supply pressure port 131, and a controlled pressure output "work port" 135. In operation, when a set point command signal is applied to the input electrical line 33*a* from system controller 20, the solid state electronics 130 compare the pressure present at the pressure output work port 135 to the pressure required by the command signal. If the command signal is higher than the pressure present, then the electronics sends a signal to the intake valve 132, opening the intake valve 132 and increasing the pressure in the output work port 135. If the command signal is lower than the pressure in the output work port 135, then the electronics sends a signal to the exhaust valve 134 opening it and thereby decreasing the pressure in the output work port 135. As stated above, valves of this type are well known in the art and operate as briefly described above to receive an electrical signal and deliver a controlled pressure output.

In operation, the air flow controller 20*c* receives the water flow signal from flowmeter 26 and multiplies the water flow signal by the user set air/water ratio. This total value is compared to the air flow signal received from the air flowmeter 51 and the output signal through line 33*a* is changed accordingly for more or reduced air flow. Thus, the system controller 20 is a "closed loop" type controller, and is preferably configured so that the update rates from the flowmeters 26 and 51 and out to the air regulating valve 33 can be adjusted to prevent hunting. For example, the update rate for the flowmeters 26 and 51 would typically be three times the update rate for the output to the air regulating valve 33. The software for the microprocessor is then made to have three data points to check for a trend off nominal before changing the output. However, the system controller 20 may employ any type of feedback control algorithm without departing from the present invention such as proportional, integral, derivative, cycle time, time proportion and the like.

The air flow controller 20*c* can cause additional air to flow by increasing compressor 12 discharge air pressure as measured by air pressure sensor 202. This is done by sending a signal from the air flow controller 20*c* through line 33*a* to the air regulating valve 33 so that the air regulating valve 33 closes, sending a lower control air pressure to the intake valve 60 via conduit 35. The lower control air pressure allows valve 60 to open due to reduced pressure in control chamber 61 acting on piston 66. Thus, more air flows into compressor 12 and the air flow into the air source 48 and the line 42 is increased and controlled by the system 6, and subsequently, the air being injected into the water flow at the air injector 16. Likewise the air flow controller 20*c* can reduce air flow via the aforementioned throttling of the intake valve 60.

In operation, air pressure from the compressor tank 48 communicates through conduit 81 and 91 to relief valve 90. In normal operation the pressure at 90*a* will be less than the setting of relief valve 90. If a system problem allows the operation pressure to rise above the setting of the relief valve 90 then pressure will be transmitted through relief valve 90 and out connection 90*b* through conduit 92 and 205 providing an increase in pressure at connection 20*a* and into the air flow control valve 60. This pressure acts on piston 66 closing intake valve member 62 and restricting intake air flow into the compressor 12, which in turn limits the air discharge from compressor tank 48, and keeps the system under control during a potential electrical failure.

As mentioned above, the compressed air foam system 6 further includes an air pressure sensor 202 coupled to the air flow controller 20*c* for sensing the pressure of the air in the air conduit 42. The air shut-off valve 50 is disposed between the source of compressed air 47 and the air injection point 16. The air flow controller 20*c* uses the sensed air pressure to control the pressure of the air when the air shut-off valve 50 is closed to thereby maintain a startup pressure. Generally, the air shut-off valve 50 closes when the water flow drops below a minimum value which may be preprogrammed or which is user adjustable. The control 20 can also operatively turn off all air flow by communicating with valve 50 so this valve closes and prevents any air flow. This is required when water flow is stopped by the nozzle 19 and extra air moving into the system is not desirable.

FIG. 3A shows that the foam flow controller 20*d* has a keypad 122 including an on/off pushbutton 123, up and down arrow keys 124*a*, 124*b*, a digital readout or display 125 and mode indicator lights 126*a*–126*d*. The mode indicator lights 126*a*–126*d* are for indicating which variable is being displayed on the digital display 125 and include water flow 126*a*, adjustable percent of foam flow to water flow 126*b*, the total water flow (quantity) 126*c* and the total foam flow 126*d*. By pressing a mode or information button 127, a user can scroll or scan through the four different display modes indicated by mode indicator lights 126*a*–126*d*. When the percent of foam flow to water flow is selected, the user can use the up and down arrow keys 124*a*, 124*b* to increase or decrease the desired setpoint for pacing the foam to water between 0.0% and 100%.

Referring now to FIG. 1, the foam flow controller 20*d* has at least one sensor input which receives input control signals through the electrical line 26*a* which transmits electrical signals from the water flowmeter transmitter 26' of the water flowmeter 26. It is contemplated that the water flow is provided to the air flow controller 20*c* by way of the network connection 20*b* in lieu of providing an additional water flow sensor input in the air flow controller 20*c*. The microprocessor U1 of the foam flow controller 20*d* has a user adjustable setpoint entered through the keypad 122 (FIG. 3A) for foam/water ratio, and an output, electrically connected to the foam proportioning apparatus 14 by way of the electrical line 14*d*. The foam flow controller 20*d* operates in a second mode which is based upon the ratio of air/foam flow as set in the air flow controller 20*c*.

In operation, in response to an electrical signal transmitted from the water flowmeter transmitter 26' of the water flowmeter 26 by way of electrical line 26*a* to the foam controller 20*d*, the amount of the foam concentrate delivered from a foam concentrate supply tank 14*a* to conduit 24 through the foam injector 27 is controlled to be at a specified injection rate as set by a user adjustable foam/water ratio setpoint. Alternately, the foam controller 20*d* is responsive to the user adjustable foam/air ratio setpoint set at the air flow controller 20*c*.

In order to protect the pump 14*b* and motor 14*c* of the foam proportioner 14, a foam concentrate supply tank low level float switch (not shown) is typically provided so that the foam proportioner 14 is interlocked when the foam concentrate tank 14*a* is empty (i.e., the drive motor 14*c* and the pump 14*b* will not run).

The compressed air foam system 6 further includes a water pressure sensor 102 coupled to the system controller 20 for measuring the pressure of the water in the conduit. The processor U1 of either the air flow controller 20*c* or the foam flow controller 20*d* is configured in a first mode to read pressure values from the water pressure sensor 102 over a range of water flow rates and in a second mode to write the pressure values read in the first mode to a data table in the memory U2. The processor U1 subsequently uses the data table to calibrate the system controller 20.

Optionally, a temperature sensor 12*c* is coupled to the air source 47 and provides an input to the system controller 20 for measuring the temperature of the air. The temperature sensor 12*c* is installed in an oil system (not shown) in the compressor 12 and communicates with the air flow controller 20*c* to allow the display of oil temperature on the air flow controller 20*c*. The air flow controller 20*c* can then bias the sensed air flow rate to compensate for temperature changes to maintain a standardized air flow rate. This also allows the compensated air flow readings to maintain standardized display of air flow in standard cubic feet per minute (SCFM). Of course, the temperature sensor 12*c* could also be coupled to the air compressor tank 48 or the air conduit 42 without departing from the present invention.

In an alternate embodiment, the compressed air foam system 6 for use in extinguishing fire further includes a variable water restriction device 200. The variable water restriction device 200 is disposed in the conduit 24. The variable water restriction device 200 is configured to selectively reduce water flow and pressure when a user desires to create an aerated mixed foam solution having higher air concentrations once the flow rate of the air being injected has reached a maximum attainable value because there is a practical saturation limit to the amount of air that may be induced into the water flow stream at the injector 16. To allow very dry mixtures of compressed air foam discharge, often in excess of SCFM to 1 gpm, a variable restriction 200 is installed between foam injection 27 and air injection 16 components. The variable restriction device 200 may be a ball valve with an actuator that permits multiple positions or a modulating type valve. The system controller 20 can restrict the water flow when an increase in air pressure can no longer increase the air flow and more air is required (i.e., when the air compressor 12 reaches its maximum output). For example, in one such possible construction the variable restriction device 200 may be a ball valve with an electric actuator such as manufactured by KZCO of Greenwood, Nebr. The ball valve 200 will optionally have a hole drilled in the ball or a bypass installed around the main valve port to prevent the complete shut off of water flow. Of course other types of valves may also be successfully employed without departing from the broad inventive scope of the present invention.

Figure 5:
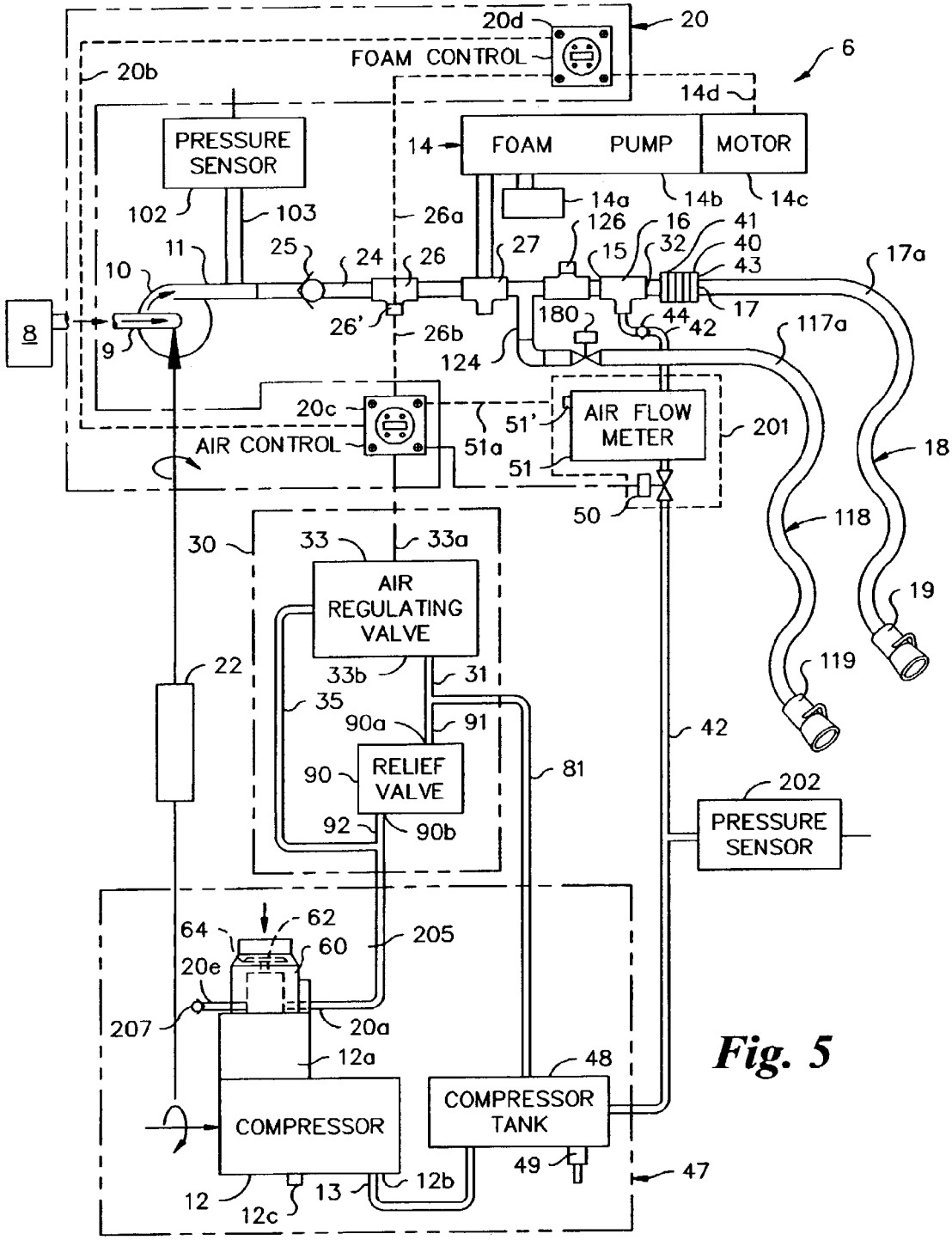
FIG. 5 is a schematic view of a compressed air foam system in accordance with a second preferred embodiment of the invention.

In another alternate embodiment shown in FIG. 5, the compressed air foam system 6 for use in extinguishing fire further includes a branch conduit 124 for foam and water only (i.e., no air). Because some of the water flow will be diverted through the branch conduit 124 and some will continue to the air injector 16, a second water flowmeter 126 is required in order to provide a proper water flow signal for pacing the air controller 20*c*. The branch conduit may include an automatic shut-off valve 180 so that the side stream of foam and water only can be selectively disabled. The compressed air foam system 6 also includes an additional solution discharge device 118 including a hose 117*a* having a nozzle 119, which is connected to the branch conduit 124. The solution discharge device 118 can be any number of discharge devices as set forth above regarding the solution discharge device 18 without departing from the present invention. The alternate embodiment provides a compressed air foam system 6 capable of delivering both water/foam and air/water/foam mixes simultaneously and/or alternately.

From the foregoing, it can be seen that the present invention comprises an apparatus and a method for controlling a compressed air foam system by monitoring and controlling water pressure, air flow, air pressure and foam flow, concurrently. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A compressed air foam system for use in extinguishing fire comprising:

a mixer having an inlet and an outlet;

a solution discharge device configured to receive mixed aerated foam solution from the outlet of the mixer and output the mixed aerated foam solution from the system;

a fire pump having a suction port and a discharge port, the fire pump being configured to pump water under pressure from the discharge port, the suction port being in fluid communication with a water source;

a conduit providing a fluid path between the discharge port of the fire pump and the inlet of the mixer;

a water flow sensor configured to sense a water flow rate of the water flowing through the conduit;

a foam proportioning apparatus configured to inject foam chemical into the water flowing through the system;

an air conduit configured to inject compressed air at an air injection point into the water flowing through one of the conduit and the mixer, the air conduit being in fluid communication with a source of compressed air;

an air flow sensor configured to sense an air flow rate of the air flowing through the air conduit;

an air flow control valve configured to control the flow of the compressed air through the air conduit; and a system controller having a user adjustable ratio input, the system controller being configured to receive the sensed water flow rate from the water flow sensor, to receive the sensed air flow rate from the air flow sensor, to output a first control signal to the air flow control valve for regulating the flow of compressed air and to output a second control signal to the foam proportioning apparatus for regulating the flow of foam relative to the sensed water flow rate, the system controller automatically adjusting the first and second control signals to maintain a ratio of air flow to foam flow based upon the user adjustable ratio input.

2. The compressed air foam system according to claim 1, wherein the source of compressed air includes an air compressor having an intake and a discharge, the air compressor drawing in air from the intake and discharging compressed air out of the compressor discharge to the air conduit.

3. The compressed air foam system according to claim 2, wherein the air flow control valve is coupled to the intake of the air compressor.

4. The compressed air foam system according to claim 3, wherein the first control signal is pulse width modulated as a function of the required air flow for regulating the flow of air.

5. The compressed air foam system according to claim 3, further comprising an air pressure sensor coupled to the system controller for sensing the pressure of the air in the air conduit and an air shut-off valve disposed between the source of compressed air and the air injection point, the system controller using the sensed air pressure to control the pressure of the air when the air shut-off valve is closed to thereby maintain a startup pressure.

6. The compressed air foam system according to claim 1, wherein the compressed air foam system further comprises a water pressure sensor coupled to the system controller for measuring the pressure of the water in the conduit.

7. The compressed air foam system according to claim 6, wherein the system controller further comprises a memory and a processor, the processor being configured in a first mode to read pressure values from the water pressure sensor over a range of water flow rates and in a second mode to write the pressure values read in the first mode to a data table in the memory, the processor subsequently using the data table to bias the user adjustable ratio of air flow to foam flow.

8. The compressed air foam system according to claim 1, wherein the system controller comprises:

an air flow controller configured to receive the sensed air flow rate from the air flow sensor and to output the first control signal to the air flow control valve for regulating the flow of air; and a foam flow controller configured to receive the sensed water flow rate from the water flow sensor and to output the second control signal to the foam proportioning apparatus for regulating the flow of foam, wherein the foam flow controller communicates to the air flow controller in order to automatically adjust the first and second control signals and in order to maintain the user adjustable ratio of air flow to foam flow as a function of the sensed water flow rate.

9. The compressed air foam system according to claim 1, further comprising a variable water restriction device disposed in the conduit, the variable water restriction device being configured to selectively reduce water flow and pressure when a user desires to create an aerated mixed foam solution having higher air concentrations once the flow rate of the air being injected has reached a maximum attainable value.

10. A control system for a compressed air foam system, the compressed air foam system having at least a pumped water line, a compressed air line coupled to an air source and to the water line, and a foam concentrate line coupled to a foam source and to the water line, the control system comprising:

a water flow sensor configured to sense a flow rate of the water flowing through the water line;

a water pressure sensor configured to sense a water pressure of the water flowing through the water line;

an air flow sensor configured to sense a flow rate of the air flowing through the air line;

an air flow control valve configured to variably throttle the air flowing through the air line and into the water flowing through the system;

a foam proportioning apparatus configured to meter the foam chemical flowing through the foam concentrate line and into the water flowing through the system; and a system controller having a user adjustable ratio input, the system controller being configured to receive the sensed water flow rate from the water flow sensor, to receive the sensed air flow rate from the air flow sensor, to output a first control signal to the air flow control valve for regulating the flow of air and to output a second control signal to the foam proportioning apparatus for regulating the flow of foam relative to the water flow rate, the system controller automatically adjusting the first and second control signals to maintain a user adjustable ratio of air flow to foam flow based upon the user adjustable ratio input.

11. The control system according to claim 10, wherein the system controller comprises:

an air flow controller configured to receive the sensed air flow rate from the air flow sensor and to output the first control signal to the air flow control valve for regulating the flow of air; and a foam flow controller configured to receive the sensed water flow rate from the water flow sensor and to output the second control signal to the foam proportioning apparatus for regulating the flow of foam.

12. The control system according to claim 11, wherein the foam flow controller communicates to the air flow controller in order to automatically adjust the first and second control signals and maintain the user adjustable ratio of air flow to foam flow as a function of the sensed water flow rate.

13. The control system according to claim 12, wherein the foam flow controller communicates to the air flow controller using a network communication protocol.

14. The control system according to claim 10, further comprising an air pressure sensor coupled to the system controller for sensing the pressure of the air in the air line, the system controller using the sensed air pressure to control the pressure of the air source.

15. The control system according to claim 10, further comprising a temperature sensor coupled to the air source and to the system controller for measuring the temperature of the air, the system controller biasing the air flow controller to compensate for temperature to maintain a standardized air flow rate.

16. A compressed air foam system for use in extinguishing fire comprising:

a mixer having an inlet and an outlet;

a solution discharge device configured to receive mixed aerated foam solution from the outlet of the mixer and output the mixed aerated foam solution from the system;

a fire pump having a suction port and a discharge port, the fire pump being configured to pump water under pressure from the discharge port, the suction port being in fluid communication with a water source;

a conduit providing a fluid path between the discharge port of the fire pump and the inlet of the mixer;

a foam proportioning apparatus configured to inject foam chemical into the water flowing through the conduit;

an air conduit configured to inject air into the water flowing through one of the conduit and the mixer, the air conduit being in fluid communication with a source of compressed air;

an air flow sensor configured to sense an air flow rate of the air flowing through the air conduit;

an air flow control valve configured to control the flow of the compressed air through the air conduit;

an air flow controller having a user adjustable setpoint, the air flow controller being configured to receive the sensed air flow rate from the air flow sensor and to output an air flow control signal to the air flow control valve for regulating the flow of air; and a variable water restriction device disposed in the conduit, the variable water restriction device being configured to selectively reduce water flow and pressure when a user desires to create an aerated mixed foam solution having higher air concentrations once the flow rate of the air being injected has reached a maximum attainable value.

17. A compressed air foam system for use in extinguishing fire comprising:

a mixer having an inlet and an outlet;

a first solution discharge device configured to receive mixed aerated foam solution from the outlet of the mixer and output the mixed aerated foam solution from the system;

a fire pump having a suction port and a discharge port, the fire pump being configured to pump water under pressure from the discharge port, the suction port being in fluid communication with a water source;

a conduit providing a fluid path between the discharge port of the fire pump and the inlet of the mixer;

a foam proportioning apparatus configured to inject foam chemical into the water flowing through the conduit;

an air conduit configured to inject air into the water flowing through one of the conduit and the mixer, the air conduit being in fluid communication with a source of compressed air;

a second solution discharge device configured to receive a foam and water solution; and a branch conduit coupled to the conduit upstream of the air conduit, the branch conduit configured to provide the foam and water solution from the conduit to the second solution discharge device.

* * * * *